US006244487B1

(12) United States Patent
Murray

(10) Patent No.: US 6,244,487 B1
(45) **Date of Patent: *Jun. 12, 2001**

(54) SAFETY AMPULE BREAKER

(76) Inventor: William M. Murray, 2650 Spring Hill La., Enola, PA (US) 17025

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/235,843

(22) Filed: Jan. 22, 1999

(51) Int. Cl.[7] ..... B26F 3/00

(52) U.S. Cl. ..... 225/93; 225/103; 241/99; 81/3.4; 215/47

(58) Field of Search ..... 225/93, 103, 96.5, 225/96; 241/99, 606, 168; 81/3.07, 3.08, 3.4; 220/675, 671, 744; 30/164.9, 164.95; 16/227, DIG. 33; 206/438, 446, 528; 215/47

(56) References Cited

U.S. PATENT DOCUMENTS

| | | | | |
|---|---|---|---|---|
| 2,865,524 | * | 12/1958 | Rexnek | 215/6 |
| 2,977,014 | * | 3/1961 | Kock | 215/13.1 |
| 3,380,636 | * | 4/1968 | Ushkow et al. | 225/103 |
| 3,544,020 | * | 12/1970 | Goldberg | 215/47 X |
| 3,720,250 | | 3/1973 | Goldberg et al. . | |
| 3,720,341 | * | 3/1973 | Greenfield et al. | 215/47 X |
| 3,999,451 | | 12/1976 | Ogle . | |
| 4,226,376 | * | 10/1980 | Pfleger | 241/99 |
| 4,353,869 | * | 10/1982 | Guth | 241/99 X |
| 4,405,069 | * | 9/1983 | Vivier et al. | 225/93 |
| 4,488,643 | * | 12/1984 | Pepper | 206/366 |
| 4,506,817 | | 3/1985 | Parker . | |
| 4,508,250 | * | 4/1985 | Punchak | 225/97 |
| 4,570,838 | * | 2/1986 | Szemere et al. | 225/93 |
| 4,659,024 | * | 4/1987 | Frunzi et al. | 241/99 |
| 5,129,566 | | 7/1992 | Ogden et al. . | |

FOREIGN PATENT DOCUMENTS

| | | | | |
|---|---|---|---|---|
| 3446989 | * | 7/1985 | (DE) | 225/93 |

OTHER PUBLICATIONS

Howmedica Ampule Breaker—See Attached Envelope.

* cited by examiner

*Primary Examiner*—Boyer Ashley
(74) *Attorney, Agent, or Firm*—Thomas Hooker, P.C.

(57) ABSTRACT

An improved ampule breaker that is snapped over an ampule tip and held in a desired location with a collar flush against the top of an ampule body, a stiff ring fulcrum support surrounding the score line in the neck of an ampule and the ampule tip closely surrounded by a plurality of locating ribs. The ampule tip is broken away from the ampule body by rotating the breaker to one side of the ampule so that the tip is rotated about the ring fulcrum and is broken away from the ampule body at the score line with a smooth break and without the formation of shards.

8 Claims, 2 Drawing Sheets

SAFETY AMPULE BREAKER

FIELD OF THE INVENTION

The invention relates to devices for breaking open ampules.

BACKGROUND OF THE INVENTION

Injection drugs, bone cement liquid and other medical supplies and liquids are often sealed in glass ampules. The ampules are closed glass containers that assure the sterility of the contents.

A typical ampule includes a cylindrical body and a bulbous tip joined by a narrowed neck. To open the ampule, the tip is snapped off the body at the neck. The neck is commonly scored to facilitate snapping off the tip. The tip is supposed to break off smoothly at the score line.

Users have difficulty opening ampules. Some users squeeze and then bend the tip. Squeezing and breaking can result in an uneven break and the formation of sharp glass shards. The shards can contaminate the contents of the ampule and easily cut the user's fingers. Even if the ampule is properly broken open, the exposed broken glass edges on the tip can inadvertently cut fingers.

Ampule breakers have been developed to make opening ampules more convenient. Conventional ampule breakers include a flexible cylindrical body that fits loosely over the ampule tip. The body is pressed against one side of the tip to snap the neck of the ampule. Some conventional ampule breakers include an outwardly extending flange or collar at the bottom of the cylinder to locate the breaker on the ampule properly and protect the fingers from exposed glass.

Conventional ampule breakers have a number of disadvantages. They fit loosely on the ampule and do not assure a clean break at the score line, resulting in sharp jagged broken glass edges and the formation of glass shards. Conventional ampule breakers do not reliably hold the broken off ampule tip, which may come out of the breaker and require manual handling with increased risk of injury.

Thus, there is a need for an improved ampule breaker. The improved ampule breaker should break the tip from the body of the ampule at the score line without jagged edges, securely hold the broken away tip for disposal and reduce exposure of broken edges on the tip and ampule body.

SUMMARY OF THE INVENTION

The present invention is an improved ampule breaker that is snapped over the ampule tip and held in a desired location with a collar flush against the top of the ampule body, a stiff ring fulcrum support surrounding the score line in the neck of the ampule and the ampule tip closely surrounded by a plurality of locating ribs. The breaker is held securely on the ampule. The ampule tip is broken from the ampule body by rotating the breaker to one side of the ampule so that the tip is rotated about the ring fulcrum and is broken away from the ampule body at the score line with a smooth break and without the formation of shards. The user's hand engaging the ampule breaker is kept away from the broken edge at the top of the ampule body. The edge at the bottom of the tip is recessed in the breaker to prevent injury. After breaking the ampule open, the tip is securely held in the ampule breaker with the broken edge safely recessed to prevent injury. The tip and breaker are then discarded.

Other objects and features of the invention will become apparent as the description proceeds, especially when taken in conjunction with the accompanying drawings illustrating the invention, of which there are three sheets.

DETAILED DESCRIPTION OF THE PREFERRED EMBODIMENT

Figure 1:
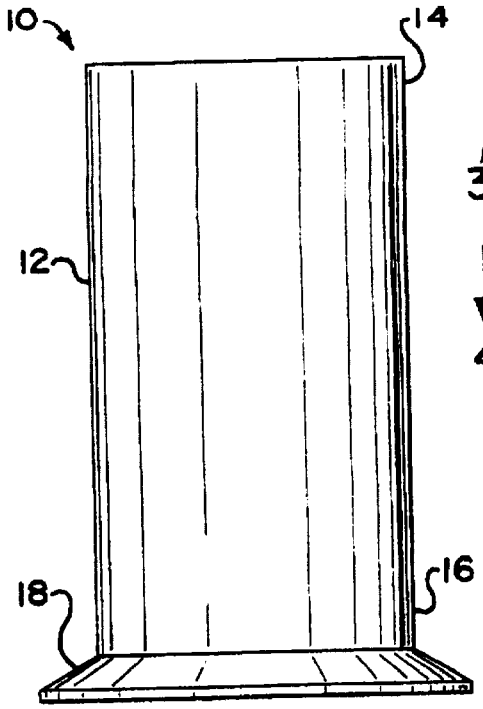
FIG. 1 is a side view of an ampule breaker in accordance with the present invention.

Ampule breaker 10 is preferably molded from a stiffly flexible thermoplastic resin and includes an open cylindrical or tubular body 12 having an upper end 14 and lower end 16. A circumferential positioning collar 18 extends downwardly and outwardly from lower end 16 and is adapted to locate the breaker 10 on the tapered shoulder at the top of an ampule body.

Figure 2:
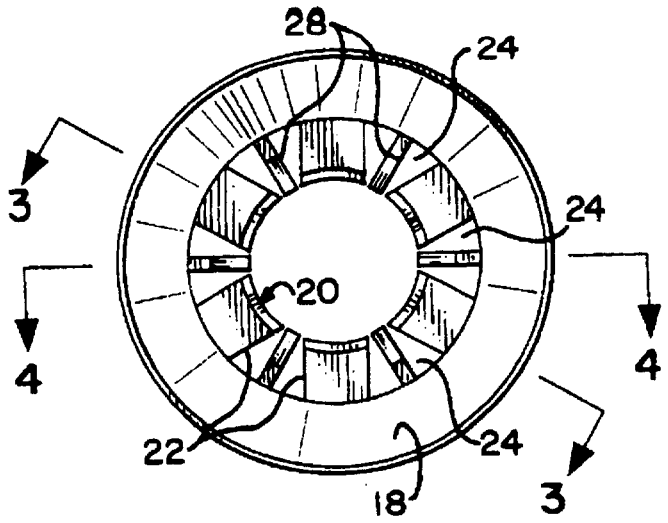
FIG. 2 is an end view of the ampule breaker shown in FIG. 1.
Figure 3:
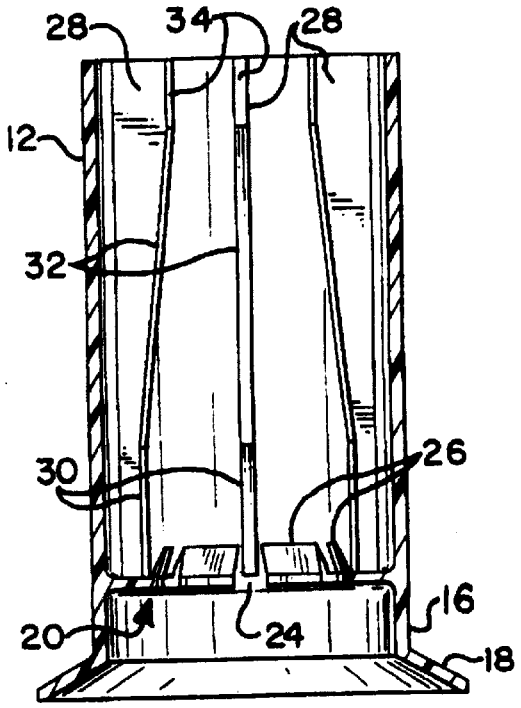
FIG. 3 is a sectional view of the ampule breaker of FIG. 2 taken along line 3—3 of FIG. 2.
Figure 4:
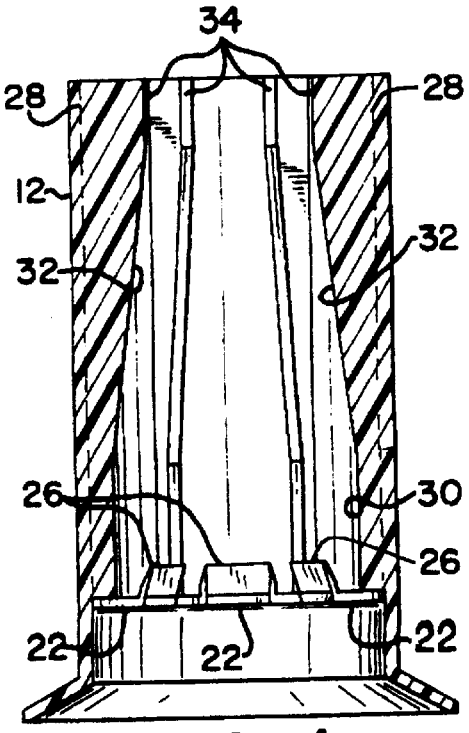
FIG. 4 is a sectional view of the ampule breaker of FIG. 2 taken along line 4—4 of FIG. 2.

Circumferential ring fulcrum 20 extends inwardly from body 12 a short distance above lower end 16 and includes a plurality of stiffly flexible fulcrum arms 22 each extending directly inwardly from the body. Tapered flexible locating fingers 26 extend upwardly and inwardly from the inner ends of arms 22. As shown in FIG. 2, arms 22 have a uniform width and are separated by generally triangular slots 24. The inner ends of arms 22 are closely spaced around the inside of ring fulcrum 20 to engage the neck of an ampule as illustrated in FIG. 2.

A plurality of radial tip alignment ribs 28 each extend radially inwardly from body 12 and run the length of the body from the ring fulcrum to upper end 14. As shown in FIG. 2, the ribs have a uniform thickness and are located between adjacent fulcrum arms 22. Each rib includes a lower edge 30 extending parallel to the axis of the ampule inside the ends of arms 22, an intermediate edge 32 which slopes toward the center of the ampule breaker and an upper edge 34 extending into the interior of body 12 approximately the same distance as arms 22. The inner edges of ribs 28 conform generally to the shape of the ampule tip to be removed by breaker 10.

Ampule breaker 10 is used to break the tip 40 of ampule 42 from cylindrical ampule body 44. The tip is joined to the body at neck 46. A score line 48 extends around the neck. Conical shoulder 50 extends from the top of body 44 to the neck 46. Tip 40 has a bulbous upper end 52 and increases in diameter below end 52 to a maximum diameter at bulge 54. The intermediate and upper edges of locating ribs 28 spaced around the ampule breaker conform closely in shape to the tip above the bulge 54.

Figure 5:
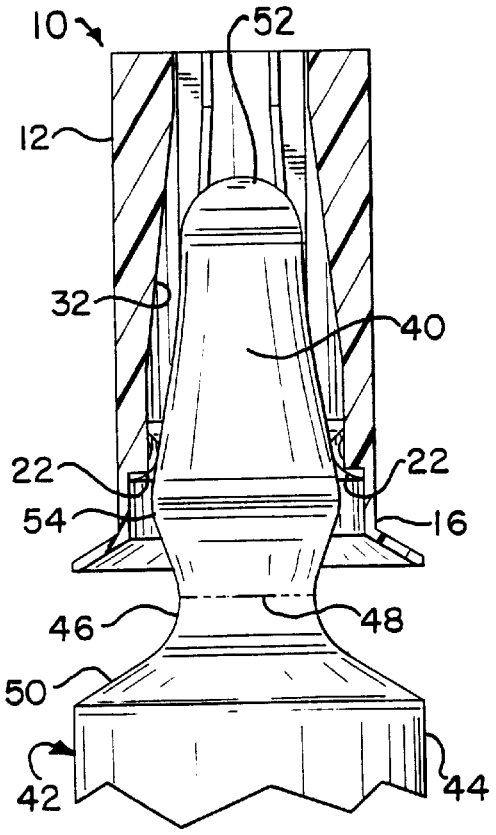
FIG. 5 is similar to FIG. 4 but with the breaker partially inserted in the ampule.
Figure 6:
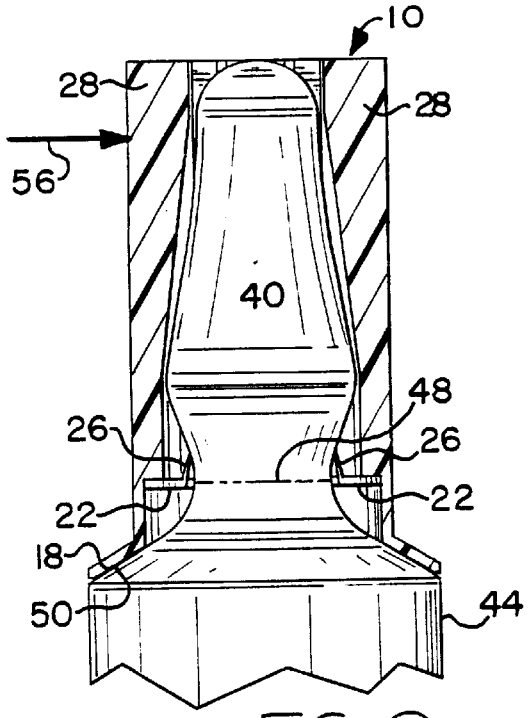
FIG. 6 is similar to FIG. 4 but with the breaker fully inserted in the ampule.
Figure 7:
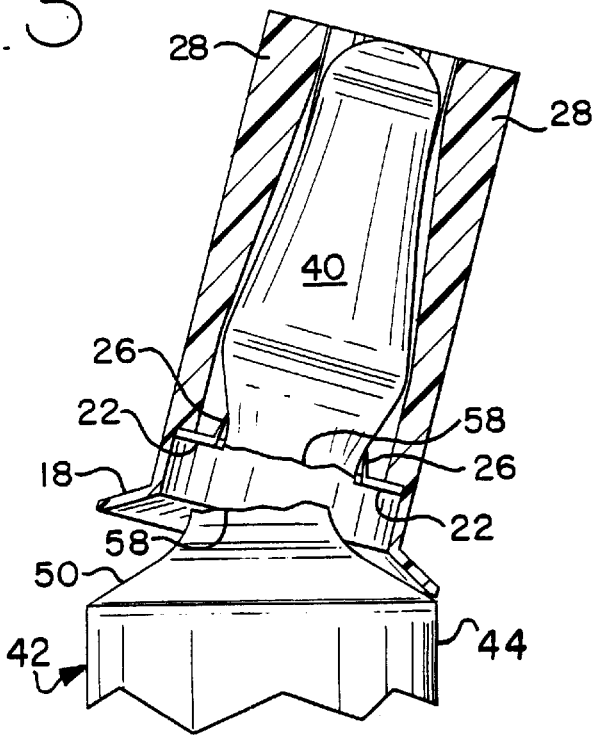
FIG. 7 is similar to FIG. 6, but with the ampule tip broken away.

FIGS. 5–7 illustrate use of ampule breaker 10 to break tip 40 from ampule 42. The breaker is first mounted on the top of the ampule by positioning the breaker above and in alignment with the tip with the lower end 16 adjacent tip upper end 52. The breaker is then lowered onto the ampule to move collar 18 down and around the tip. The bulbous end 52 has a diameter less than the inner diameter of the ring fulcrum 20 and is extended freely into the ring to assure proper alignment between the breaker and the ampule. Further movement of the breaker onto the ampule moves the outwardly flared sides of the tip into contact with the inner ends of the fulcrum arms 22 and bends the arms 22 up and out toward cylindrical body 12 as shown in FIG. 5 until the bulge 54 is moved past the ring fulcrum and the arms snap back into the neck 46. Continued downward movement of the breaker seats positioning collar 18 on shoulder 50 to locate the ring fulcrum 20 at the level of score line 48. The flexible locating fingers 26 have a normal minimum spacing less than the diameter of the tip above the score line and are flexed outwardly somewhat to hold and properly position the tip in the breaker and secure the tip in the breaker 10 after it is broken away from the body.

With the ampule breaker fully mounted on the top of the ampule, as shown in FIG. 6, collar 18 rests flush on the shoulder 50 and the ampule tip is closely confined within the upper portion of the breaker between the intermediate and upper edges 32 and 34 of locating ribs 28 with the ring fulcrum at the score line. The entire tip 40 is held in breaker 10.

With the breaker in place on the ampule, tip 40 is cleanly and safely broken away from the ampule body by applying a lateral force indicated by arrow 56 to the top of the breaker tending to rotate the breaker and held tip to one side of the body. The force is typically applied by gripping the ampule breaker and rotating it to apply a torque between one side of the top of the breaker and the ampule neck on the opposite side of the holder. Application of the torque moves the ring fulcrum on the opposite side against the neck 46 at the score line. At the same time, the user breaking away the ampule tip holds the breaker down against shoulder 50 to assure that the arms 22 are located at the score line. Application of the torque on the tip as described is sufficient to break the tip away from the ampule body at the score line as shown in FIG. 7 and form clean break edges 58 at the top of the ampule and at the bottom of the broken away tip. During breaking, the flexible locating finger or fingers 26 on the fulcrum arms which engage the neck are flexed to permit the neck to contact the arm or arms. The tip is held closely within the ampule breaker to prevent substantial lost motion movement of the breaker relative to the tip. Immediately following breaking away of the ampule tip, the breaker and held tip are typically rotated a slight distance to one side of the ampule body as shown in FIG. 7. The collar 18 on the side of the breaker to which the breaking torque is applied is lifted above shoulder 50 and the collar on the opposite side of the breaker is flexed outwardly.

After breaking, the broken away ampule tip 40 is held in breaker 10. Ribs 28 prevent movement of the tip out of the upper end of the breaker. Ring fulcrum 20 prevents movement of the tip out of the bottom of the breaker. The broken edge 58 at the bottom of the tip is located an appreciable distance above the bottom of the breaker to reduce the risk of injury to the user handling the breaker and held tip. The breaker and broken away tip are safely discarded. Ampule breaker 10 breaks away tip 40 smoothly at the score line 48 without formation of glass shards to provide a smooth break line 58 at the top of the ampule body 44.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. An ampule breaker for breaking an ampule tip from an ampule body of a glass ampule, wherein the ampule tip is connected to the ampule body by an ampule neck and shoulder between the ampule tip and body, the breaker comprising:

an elongated tubular body having opposed upper and lower ends and a hollow interior open at said lower end of the tubular body;

a positioning collar on the lower end of the tubular body, the collar extending around the lower end of the tubular body and outwardly and downwardly from the lower end of the tubular body to rest on the shoulder of glass ampule when the tubular body is positioned on the tip of the ampule;

a plurality of tip alignment members spaced around the interior of the tubular body, said members extending inwardly from the tubular body to edges located within the tubular body, said edges conforming to the shape of the ampule tip located within the tubular body to hold the ampule tip in alignment in the tubular body during breaking of the tip from the ampule body; and a circumferential ring fulcrum extending radially inwardly from the tubular body, the ring fulcrum located between the positioning collar and the alignment members, said ring fulcrum having an inner diameter less than a maximum diameter of the ampule tip, the ring fulcrum bendable up into the tubular body to permit movement of the ampule tip past the ring fulcrum and into the interior of the elongated tubular body from the lower end of the ampule body so that the ampule tip is positioned between the edges of the alignment members and the ring fulcrum surrounds the ampule neck, the ring fulcrum also being radially stiff to engage the neck of the ampule, the ring fulcrum comprising a plurality of fulcrum arms spaced around the interior of the tubular body, said fulcrum arms located circumferentially between said alignment members, wherein when the ampule breaker is positioned on the tip of the ampule with the tubular body surrounding the tip and the collar on the shoulder of the ampule body a lateral force applied to the upper end of the tubular body moves the ring fulcrum into engagement with the neck of the ampule to break the ampule tip from the ampule body at the neck and the alignment members and the ring fulcrum retain the ampule tip separated from the ampule body in the elongated tubular body.

2. The ampule breaker as in claim 1 wherein said tubular body, said collar, said alignment members and said ring fulcrum are formed from a single piece of thermoplastic resin.

3. The ampule breaker as in claim 2 wherein said tubular body is cylindrical and said collar is annular.

4. An ampule breaker for breaking an ampule tip from an ampule body of a glass ampule, wherein the ampule tip is connected to the ampule body by an ampule neck and shoulder between the ampule tip and body, the breaker comprising:

an elongated tubular body having opposed upper and lower ends and a hollow interior open at said lower end of the tubular body;

a positioning collar on the lower end of the tubular body, the collar extending around the lower end of the tubular body and outwardly and downwardly from the lower end of the tubular body to rest on the shoulder of the glass ampule when the tubular body is positioned on the tip of the ampule;

a plurality of tip alignment members spaced around the interior of the tubular body, said members extending inwardly from the tubular body to edges located within the tubular body, said edges conforming to the shape of the ampule tip located within the tubular body to hold the ampule tip in alignment in the tubular body during breaking of the tip from the ampule body; and a circumferential ring fulcrum extending radially inwardly from the tubular body, the ring fulcrum located between the positioning collar and the alignment members, said ring fulcrum having an inner diameter less than a maximum diameter of the ampule tip, the ring fulcrum bendable up into the tubular body to permit movement of the ampule tip past the ring fulcrum and into the interior of the elongated tubular body from the lower end of the elongated tubular body so that the ampule tip is positioned between the alignment members and the ring fulcrum surrounds the ampule neck, the ring fulcrum also being radially stiff to engage the neck of the ampule, wherein when the ampule breaker is positioned on the tip of the ampule with the tubular body surrounding the tip and the collar on the shoulder of the ampule body a lateral force applied to the upper end of the tubular body moves the ring fulcrum into engagement with the neck of the ampule to break the ampule tip from the ampule body at the neck and the alignment members and the ring fulcrum retain the ampule tip separated from the ampule body in the elongated tubular body.

5. The ampule breaker as in claim 4 wherein said alignment members comprise radial ribs.

6. The ampule breaker as in claim 5 wherein said ribs extend along the tubular body between the upper end and the ring fulcrum.

7. The ampule breaker as in claim 6 wherein the ring fulcrum comprises a plurality of fulcrum arms spaced around the interior of the tubular body and extending into the tubular body.

8. The ampule breaker as in claim 7 wherein said fulcrum arms extend radially inwardly from the tubular body and include a flexible locating finger extending upwardly and inwardly from an inner end of each fulcrum arm.

* * * * *